US010429046B2

(12) United States Patent
Zhao et al.

(10) Patent No.: US 10,429,046 B2
(45) Date of Patent: Oct. 1, 2019

(54) LIGHTING DEVICE

(71) Applicant: GE Lighting Solutions, LLC, East Cleveland, OH (US)

(72) Inventors: Yong Zhao, Shanghai (CN); Jian Wang, Shanghai (CN)

(73) Assignee: CURRENT LIGHTING SOLUTIONS, LLC, East Cleveland, OH (US)

( * ) Notice: Subject to any disclaimer, the term of this patent is extended or adjusted under 35 U.S.C. 154(b) by 0 days.

(21) Appl. No.: 15/636,679

(22) Filed: Jun. 29, 2017

(65) Prior Publication Data

US 2018/0010778 A1 Jan. 11, 2018

(30) Foreign Application Priority Data

Jul. 8, 2016 (CN) ..... 2016 1 0536467

(51) Int. Cl.

| | |
|---|---|
| ***F21V 21/00*** | (2006.01) |
| ***F21V 23/04*** | (2006.01) |
| ***F21V 23/00*** | (2015.01) |
| ***F21S 2/00*** | (2016.01) |
| ***F21S 8/08*** | (2006.01) |
| ***G08G 1/04*** | (2006.01) |
| *F21V 29/502* | (2015.01) |
| *F21V 21/15* | (2006.01) |
| *F21W 131/103* | (2006.01) |

(52) U.S. Cl.

CPC ..... *F21V 23/0478* (2013.01); *F21S 2/005* (2013.01); *F21S 8/086* (2013.01); *F21V 23/002* (2013.01); *F21V 23/045* (2013.01); *G08G 1/04* (2013.01); *F21V 21/15* (2013.01); *F21V 29/502* (2015.01); *F21W 2131/103* (2013.01)

(58) Field of Classification Search

USPC ..... 362/217.12

See application file for complete search history.

(56) References Cited

U.S. PATENT DOCUMENTS

| | | | | |
|---|---|---|---|---|
| 6,352,358 B1 * | 3/2002 | Lieberman | ..... | F21V 15/00 362/218 |
| 2012/0080944 A1 * | 4/2012 | Recker | ..... | H02J 9/02 307/25 |

(Continued)

FOREIGN PATENT DOCUMENTS

CN 201982994 U 9/2011

*Primary Examiner* — Tuyen K Vo

(74) *Attorney, Agent, or Firm* — Buckley, Maschoff & Talwalkar, LLC

(57) ABSTRACT

A lighting device comprising a housing arranged with at least one first housing space and at least one second housing space; at least one first illumination module respectively arranged in the at least one or more first housing space and at least one first auxiliary functional module, respectively arranged in the at least one second housing spaces; wherein each of the first auxiliary functional modules includes at least one of a communication module, a sensor module or a camera module. The lighting device arranged according to an embodiment of the present invention not only satisfies the lighting demand of existing urban planning, but also facilitates the upgrading of intelligent lighting devices with such functions as temperature detection, traffic monitoring and alarm, at a low cost.

7 Claims, 3 Drawing Sheets

(56) References Cited

U.S. PATENT DOCUMENTS

| | | | | |
|---|---|---|---|---|
| 2013/0215606 | A1* | 8/2013 | Wang | F21S 8/086<br>362/190 |
| 2015/0115802 | A1 | 4/2015 | Kuti et al. | |
| 2015/0173148 | A1* | 6/2015 | Casper | F21V 23/02<br>315/152 |
| 2015/0362172 | A1* | 12/2015 | Gabriel | G08B 15/001<br>348/151 |
| 2016/0323967 | A1* | 11/2016 | Elwell | H05B 37/0218 |

* cited by examiner

LIGHTING DEVICE

TECHNICAL FIELD

The present invention relates generally to a lighting device, and more particularly to a lighting device.

BACKGROUND ART

Street lights are an important part of urban lighting, with the traditional street lights generally having a fixed size or power and only able to provide a single lighting function. With the development of intelligent city concepts, the demand for intelligent equipment in cities will gradually increase. The traditional single lighting function will not meet the future needs of intelligent cities, whereas intelligent street lights integrated with power control, temperature detection, camera, environmental monitoring, communication, as well as other functions can meet the needs of an intelligent city.

However, within current urban development, the short-term demand for intelligent lights is not high, with existing street lights only providing lighting function able to meet the city's basic street lighting needs. However, during the process of upgrading traditional street lights into intelligent lights in the future, a huge amount of human, material and financial resources will be required to replace all the traditional street lighting facilities.

Therefore, it is necessary to provide a street lighting device that can provide lighting to meet the needs of existing cities and to facilitate future upgrades, thereby solving at least one of the problems as described above.

BRIEF DESCRIPTION OF THE INVENTION

One of the objectives of embodiments of the present invention is to provide a street lighting device which can not only meet the needs of current urban lighting, but also facilitate the upgrade to intelligent street lighting devices in the future.

One aspect of the present invention is to provide a lighting device comprising: a housing arranged with at least one first housing space and at least one second housing space; at least one first lighting module respectively arranged in the one or more first housing spaces; and at least one first auxiliary functional module, respectively arranged in the one or more second housing spaces; wherein each of the first auxiliary functional modules includes at least one communication module, a sensor module or a camera module.

Alternatively, the first auxiliary functional module comprises an electrical connector for supplying power thereto.

Alternatively, the lighting device further comprises a power supply module including a communication unit for communicating between the first auxiliary functional module and the power supply module or the remote server.

Alternatively, the housing includes a base portion and a first extension extending outward from the base portion, the first housing space and the second housing space being arranged on the first extension.

Alternatively, a chamber is arranged on the base portion, and the power module is mounted in the chamber.

Alternatively, the lighting device further comprises a second extension, the second extension and the first extension being detachably connected, the second extension being arranged with at least one third housing space used to mount the second lighting module or the second auxiliary functional module.

Alternatively, the first lighting module is arranged with a heat sink for radiating heat, and each of the first auxiliary functional modules is arranged with a heat sink for radiating heat.

Another aspect of the present invention is to provide a lighting device comprising: a housing arranged with at least one first housing space and at least one second housing space; at least one first lighting module respectively arranged in the one or more first housing spaces; and at least one first auxiliary functional module respectively arranged in the one or more second housing spaces, with each of the first auxiliary functional modules comprising at least one communication module, a sensor module, or a camera module; wherein each of the first auxiliary functional modules further comprises an electrical connector for supplying power thereto, the electrical connector comprising a communication unit used for communication between the first auxiliary functional module and the power supply module or the remote server.

The lighting device of an embodiment of the present invention has the first housing space to install the lighting module and the second housing space to install the auxiliary functional module, which can realize the integration of functions into the lighting module, such as monitoring environmental parameters, providing communication or 3G/4G network signal, monitoring traffic conditions, alarm, and so on. This not only meets the needs of existing urban planning lighting functions, but also makes it easy to perform lower-cost upgrades in the future to intelligent lighting with functions such as temperature detection, traffic monitoring, alarm, and so on.

In addition, the lighting module has an electrical connector, which allows the lighting device of an embodiment of the present invention to communicate with the power supply module or the remote server through the electrical connector, to achieve a wider range of upgrade requirements, such as obtaining a signal that adjusts the brightness and power of the lighting device, such that the lighting device may provide different lighting brightness in different weather conditions to the outside world.

Furthermore, the lighting device of the technical solution of an embodiment of the present invention has the advantage of being able to detachably mount onto the extension, thereby facilitating the installation of the lighting module or other functional modules based on future demand, making it economical and convenient.

BRIEF DESCRIPTION OF THE DRAWINGS

These and other features, aspects and advantages of the present invention will become better understood when the following detailed description is read with reference to the accompanying drawings, in which like reference numerals are used throughout the drawings to refer to like parts, where.

DETAILED DESCRIPTION OF THE INVENTION

Embodiments of the present invention will be described in detail below with reference to the accompanying drawings in order to facilitate those skilled in the art to fully understand the subject matter claimed by the present invention. In the following detailed description of these specific embodiments, the present specification does not describe in detail any of the known functions or configurations, to avoid unnecessary details that may affect the disclosure of the present invention.

Unless otherwise defined, the technical and scientific terms used in the claims and the specification are as they are usually understood by those skilled in the art to which the present invention pertains. "First", "second" and similar words used in this specification and in the claims do not denote any order, quantity or importance, but are merely intended to distinguish between different constituents. The terms "one", "a" and the like are not meant to be limiting, but rather denote the presence of at least one. "Comprising", "consisting" and similar words mean that elements or articles appearing before "comprising" or "consisting" include the elements or articles and their equivalent elements appearing behind "comprising" or "consisting", not excluding any other elements or articles. "Connected", "coupled" and similar words are not restricted to physical or mechanical connections, but may include electrical connections, whether direct or indirect.

Figure 1:
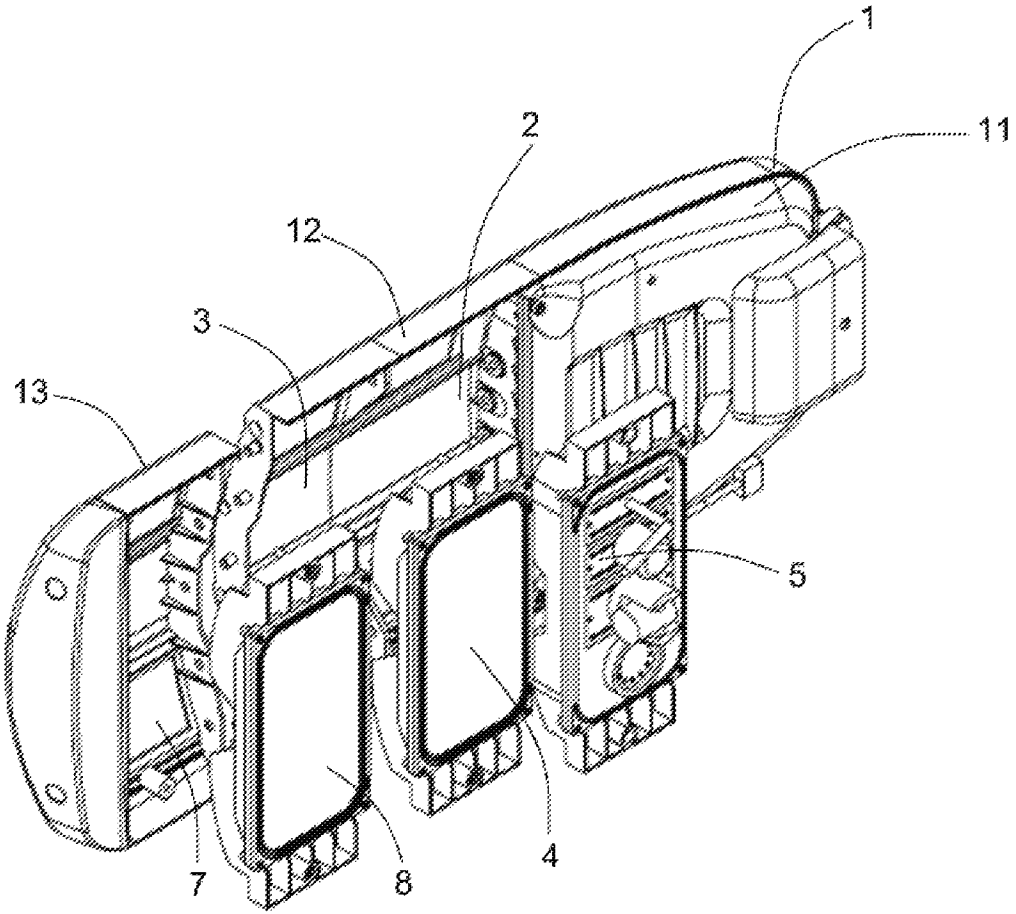
FIG. 1 is an exploded view of a lighting device.

FIG. 1 shows a structural exploded view of a fixture according to an embodiment of the present invention. As shown in FIG. 1, in the present embodiment, the lighting device includes a housing 1, at least one first lighting module 4, and at least one first auxiliary functional module 5. The housing 1 is arranged with at least one first housing space 2 and at least one second housing space 3. The at least one first lighting module 4 is arranged in the at least one first housing space 2, and the at least one first auxiliary functional module 5 is arranged respectively in the at least one second housing space 3. Wherein, each of the first auxiliary functional modules 5 includes at least one of a communication module, a sensor module, or a camera module.

Alternatively, at least one first lighting module 4 may be arranged in at least one second housing space 3, and at least one first auxiliary functional module 5 may be respectively arranged in at least one first housing space 2.

In embodiments of the present invention, the housing 1 includes a base portion 11 and a first extension 12 extending outward from the base portion, where the first housing space 2 and the second housing space 3 are arranged on the first extension 12.

Alternatively, the lighting device may further include a second extension 13, which is detachably connected to the first extension 12 and is arranged with at least one third housing space 7, each of the third housing spaces is being used to mount the module 8, which may be a second lighting module or a second auxiliary functional module 8.

In an embodiment of the present invention, the first illumination module 4 and the second illumination module may be LED lighting modules, and their structure and size may be identical. The first auxiliary functional module 5 and the second auxiliary functional module may also be configured with the same size and structure to facilitate modular production.

In addition, in an embodiment, the first housing space 2, the second housing space 3 and the third housing space 7 are configured as a space having the same size and structure. The first lighting module 4, the second lighting module, the first auxiliary functional module 5 and the second auxiliary functional module may be configured as modules of the same size and configured to be able to be mounted in the respective housing space in the same mounting manner, in order to facilitate the installation of different modules in the above-mentioned housing spaces according to the different needs of the lighting devices on different occasions. For example, the second housing space 3 may be used as a reserved space in which the first auxiliary functional module 5 is not installed or the first lighting module 4 is temporarily installed therein, and when it is necessary to upgrade the lighting device so as to have an auxiliary function, the first auxiliary functional module 5 may be installed in the reserved second housing space 3, or the first lighting module 4 installed in the second housing space 3 may be replaced with the first auxiliary functional module 5.

The auxiliary functions other than the above-mentioned lighting may include, for example, detecting the environmental parameters in the vicinity of the lighting device through the sensor module, communicating with the remote server through the communication module or providing 3G/4G network signal, monitoring traffic conditions through the camera module, and so on.

In an embodiment of the present invention, the lighting device further comprises a power supply module mounted in a chamber (not shown) arranged in the base portion.

Figure 2:
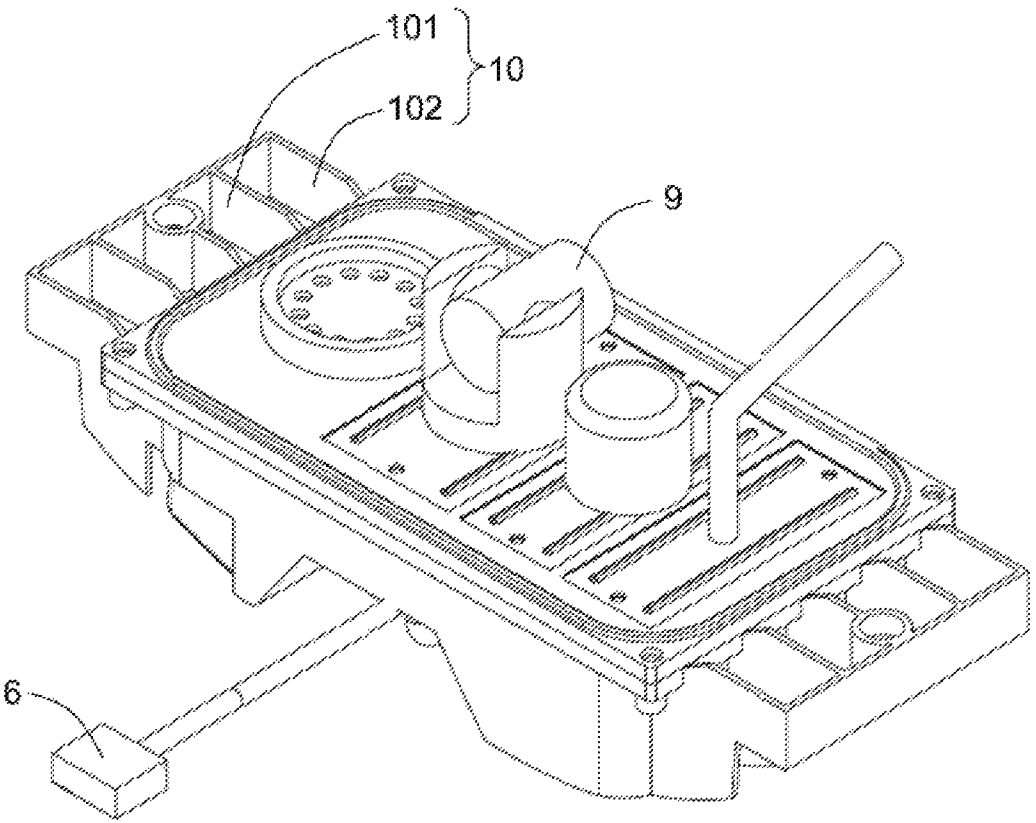
FIG. 2 is a schematic diagram of the first auxiliary functional module of FIG. 1.

FIG. 2 is a schematic structural view of the first auxiliary functional module 5. As shown in FIG. 2, the first auxiliary functional module 5 includes an electrical connector 6 for supplying power thereto. The electrical connector 6 includes a communication unit for communicating between the first auxiliary functional module 5 and its power supply module or remote server. As an embodiment, the communication unit may transmit a signal for controlling the brightness and power of the lighting device to the power supply module, or transmit to the remote server a control signal for controlling the operations of the lighting device through a cable or wirelessly.

In an embodiment of the present invention, the first auxiliary functional module 5 may further include an acquisition device 9. The acquisition device 9 may be a wired/wireless communication device, a sensor or a camera/image processor.

In the embodiment of the present invention, the first lighting module 4, the second lighting module, the first auxiliary functional module 5, and the second auxiliary functional module are arranged with a heat sink 10 for cooling itself.

The heat sink 10 includes a through hole 102 formed between the heat dissipation rib 101 and the heat radiating ribs to facilitate heat dissipation while avoiding dust.

Figure 3:
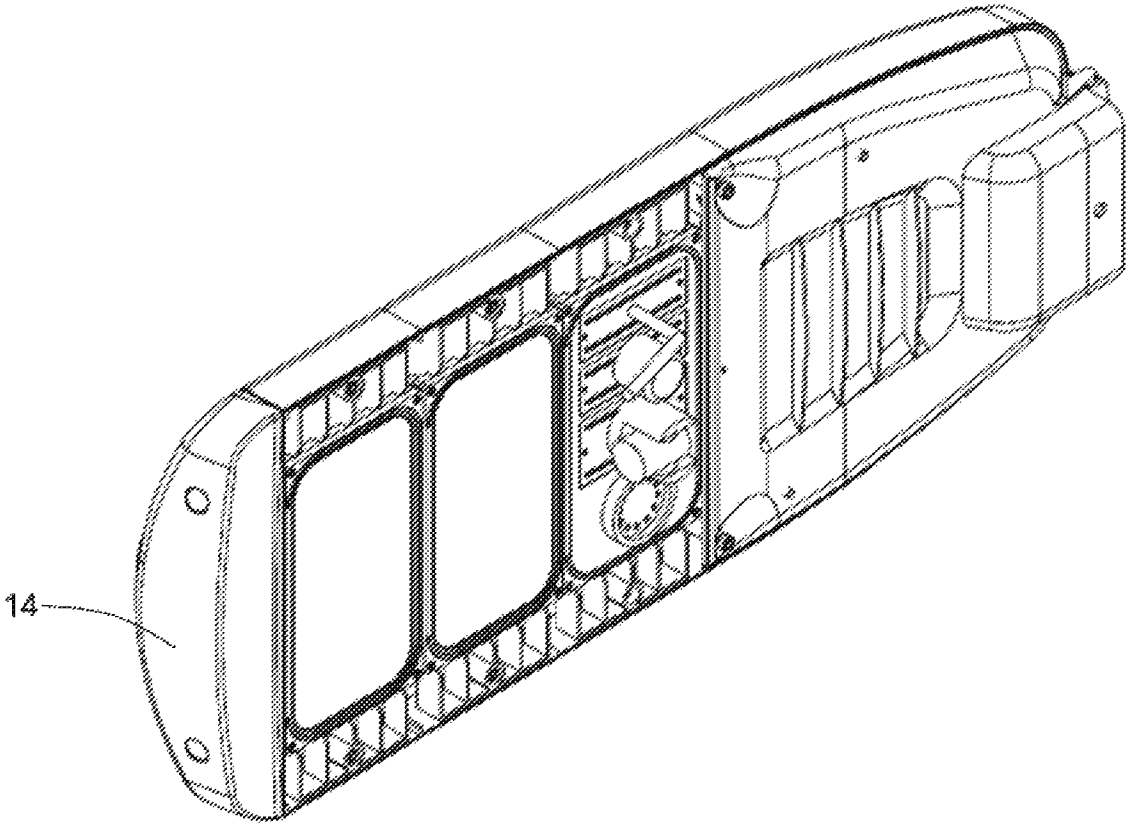
FIG. 3 is a schematic view of the overall structure of a fixture.

FIG. 3 is a schematic view of the overall structure of a lighting device according to an embodiment of the present invention. As shown in FIG. 3, the lighting device further includes an end cap 14 which is attached to one end of the second extension 13. When the lighting device does not have the second extension 13, the end cap 14 may be mounted at one end of the first extension 12. In addition, the lighting device can also use a design without the use of end caps.

The lighting device of an embodiment of the present invention facilitates the modular upgrading of the lighting device, because of the second extension 13 which is detachably connected to the first extension. This has ensured the economic and convenient extension of the lighting device structure, under the condition of not replacing the body of the lighting device, thereby achieving the objective of expanding its use.

In addition, the lighting fixture of an embodiment of the present invention has the first housing space to install the lighting module, and has the second housing space to install the auxiliary functional module, which can realize the integration of functions into the lighting module, such as monitoring environmental parameters, providing communication or 3G/4G network signal, monitoring traffic conditions, alarm, and so on. This not only meets the needs of existing urban planning lighting functions, but also makes it easy to perform lower-cost upgrades in the future to intelligent lighting with functions such as temperature detection, traffic monitoring, alarm, and so on.

Also, the lighting module has an electrical connector, which allows the lighting device of an embodiment of the present invention to communicate with the power supply module or the remote server through the electrical connector. This achieves a wider range of upgrade requirements, such as obtaining a signal that adjusts the brightness and power of the lighting device, such that the lighting device may provide different lighting brightness in different weather conditions to the outside world.

While the present invention has been described in detail with reference to specific embodiments thereof, it will be understood by those skilled in the art that many modifications and variations can be made in the present invention. It is, therefore, to be understood that the appended claims are intended to cover all such modifications and variations insofar as they are within the true spirit and scope of the invention.

What is claimed is:

1. A lighting device, comprising:

a housing with one or more first housing spaces and one or more second housing spaces therein;

one or more first lighting modules arranged inside the one or more first housing spaces respectively; and one or more first auxiliary functional modules arranged inside the one or more second housing spaces respectively, wherein one or more of the first auxiliary functional modules comprise a communication module, a sensor module or a camera module;

wherein each of the one or more first lighting modules and the one or more first auxiliary functional modules are configured as modules of the same size and configured to be able to be mounted in the respective housing space in the same mounting manner.

2. The lighting device of claim 1, wherein each of the one or more first auxiliary functional modules comprise an electrical connector, wherein the electrical connector is configured to provide power supply to the first auxiliary functional module.

3. The lighting device of claim 2, further comprising a power module, the electrical connector providing communications between the first auxiliary functional module and the power module or a remote server.

4. The lighting device of claim 3, wherein the housing further comprises a base portion and a first extension portion extending from the base portion, the one or more first housing spaces and the one or more second housing spaces are arranged on the first extension portion.

5. The lighting device of claim 1, wherein each of the one or more first lighting modules, and each of the one or more first auxiliary functional modules further comprise a heat sink for cooling itself.

6. A lighting device, comprising:

a housing with one or more first housing spaces and one or more second housing spaces therein;

one or more first lighting modules arranged inside the one or more first housing spaces respectively; and one or more first auxiliary functional modules arranged inside the one or more second housing spaces respectively, wherein one or more of the first auxiliary functional modules comprise a communication module, a sensor module or a camera module, wherein each of the one or more first auxiliary functional modules comprise an electrical connector, wherein the electrical connector is configured to provide power supply to the first auxiliary functional module, wherein each of the one or more first lighting modules and the one or more first auxiliary functional modules are configured as modules of the same size and configured to be able to be mounted in the respective housing space in the same mounting manner;

the lighting device further comprising a power module, the electrical connector comprises a communication unit for providing communications between the first auxiliary functional module and the power module or a remote server, wherein the housing further comprises a base portion and a first extension portion extending from the base portion, the one or more first housing spaces and the one or more second housing spaces are arranged on the first extension portion , the lighting device further comprising a second extension portion, the second extension portion is detachably connected to the first extension portion, at least one third housing space is arranged in the second extension portion for holding a second lighting module or a second auxiliary functional module.

7. A lighting device, comprising:

a housing with one or more first housing spaces and one or more second housing spaces therein;

one or more first lighting modules arranged inside the one or more first housing spaces respectively; and one or more auxiliary functional modules arranged inside the one or more second housing spaces respectively, wherein each of one or more of the auxiliary functional modules comprise a communication module or a camera module, wherein each of the one or more first lighting modules and the one or more first auxiliary functional modules are configured as modules of the same size and configured to be able to be mounted in the respective housing space in the same mounting manner;

wherein each of the one or more auxiliary functional modules comprises an electrical connector, wherein the electrical connector is configured to provide power to the one or more auxiliary functional modules, the electrical connector also facilitating communication between the one or more auxiliary functional modules and a remote server.

* * * * *